US010829350B2

(12) United States Patent
Fukumori et al.

(10) Patent No.: US 10,829,350 B2
(45) Date of Patent: Nov. 10, 2020

(54) CRANE

(71) Applicant: TADANO LTD., Kagawa (JP)

(72) Inventors: Yasuhiro Fukumori, Kagawa (JP); Naoto Kawabuchi, Kagawa (JP); Naofumi Yoshida, Kagawa (JP)

(73) Assignee: TADANO LTD., Kagawa (JP)

( * ) Notice: Subject to any disclaimer, the term of this patent is extended or adjusted under 35 U.S.C. 154(b) by 299 days.

(21) Appl. No.: 16/090,399

(22) PCT Filed: Apr. 7, 2017

(86) PCT No.: PCT/JP2017/014556

§ 371 (c)(1),
(2) Date: Oct. 1, 2018

(87) PCT Pub. No.: WO2017/175864

PCT Pub. Date: Oct. 12, 2017

(65) Prior Publication Data

US 2019/0112167 A1 Apr. 18, 2019

(30) Foreign Application Priority Data

Apr. 8, 2016 (JP) ..... 2016-078496

(51) Int. Cl.
*B66C 23/88* (2006.01)
*B66D 1/54* (2006.01)
(Continued)

(52) U.S. Cl.
CPC ..... *B66C 23/88* (2013.01); *B66C 1/36* (2013.01); *B66C 23/36* (2013.01); *B66C 23/705* (2013.01);
(Continued)

(58) Field of Classification Search
CPC ..... B66C 13/14; B66C 13/20; B66C 13/22; B66C 15/00; B66C 23/88; B66C 23/90; B66C 23/905; B66D 1/54
See application file for complete search history.

(56) References Cited

U.S. PATENT DOCUMENTS 3,924,752 A * 12/1975 Hoofnagle ..... B66C 15/06 212/280
4,067,447 A * 1/1978 Goss ..... B66C 13/50 212/281
(Continued)

FOREIGN PATENT DOCUMENTS

CN 104444882 A 3/2015
JP 08091772 A * 4/1996 ..... B66C 23/905
(Continued)

OTHER PUBLICATIONS

Machine Translation JP-08091772 (Year: 1996).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

A crane 1, the hook (main hook 24) of which is stored on the lower end of a boom 7, and the winch (main winch 9) of which can be moved by a hydraulic motor 37, said crane being provided with a pressure sensor 55 capable of detecting the pressure of hydraulic fluid being delivered to the hydraulic motor 37, and a controller 61 capable of recognizing changes in the pressure of the hydraulic fluid on the basis of a signal from the pressure sensor 55, and also being provided with an anomaly warning means Mi capable of providing warning of anomalies pertaining to the storage of at least the hook (24), the controller 61 activating the anomaly warning means Mi when it is determined that the
(Continued)

pressure of the hydraulic fluid when the hook has been stored is below a minimum value.

4 Claims, 11 Drawing Sheets

(51) Int. Cl.
*B66C 1/36* (2006.01)
*B66C 23/36* (2006.01)
*B66C 23/70* (2006.01)

(52) U.S. Cl.
CPC ..... *B66D 1/54* (2013.01); *B66C 2700/0357* (2013.01)

(56) References Cited

U.S. PATENT DOCUMENTS 4,424,909 A * 1/1984 Bergeron ..... B66C 15/06 212/280
4,535,899 A * 8/1985 Bergeron ..... B66C 15/06 212/280
5,263,660 A * 11/1993 Brozik ..... B66D 3/24 212/281
6,068,145 A * 5/2000 Luke ..... B66C 13/50 212/281
6,343,703 B1 * 2/2002 Fleagle ..... B66C 13/46 212/281
6,549,139 B2 * 4/2003 Shaw, Jr. ..... B66C 13/44 212/276
6,744,372 B1 * 6/2004 Shaw ..... B66C 13/44 212/276
6,894,621 B2 * 5/2005 Shaw ..... B66C 13/44 212/276
2011/0187548 A1 * 8/2011 Maynard ..... B66C 15/045 340/685
2013/0103271 A1 * 4/2013 Best ..... G01S 19/14 701/50
2014/0027401 A1 * 1/2014 Ilaka ..... G01N 3/08 212/276
2017/0217738 A1 * 8/2017 Saker ..... B66D 1/56
2017/0217739 A1 * 8/2017 Williams ..... B66C 23/88

FOREIGN PATENT DOCUMENTS

JP 2011-098824 A 5/2011
JP 2015-009939 A 1/2015
WO WO-2016092719 * 6/2016 ..... B66C 23/88

OTHER PUBLICATIONS

Machine Translation WO-2016092719 (Year: 2013).*
Machine Translation JP-2011098824 (Year: 2011).*
Jul. 18, 2017, International Search Report issued for related PCT application No. PCT/JP2017/014556.
Jul. 18, 2017, International Search Opinion issued for related PCT application No. PCT/JP2017/014556.

* cited by examiner

CRANE

CROSS REFERENCE TO PRIOR APPLICATION

This application is a National Stage Patent Application of PCT International Patent Application No. PCT/JP2017/014556 (filed on Apr. 7, 2017) under 35 U.S.C. § 371, which claims priority to Japanese Patent Application No. 2016-078496 (filed on Apr. 8, 2016), which are all hereby incorporated by reference in their entirety.

TECHNICAL FIELD

The present invention relates to a crane. Specifically, the present invention relates to a crane that includes a hook storing apparatus.

BACKGROUND ART

Conventionally, a crane that hoists and carries a load has been known (see PTL 1). The crane includes: a boom; a wire rope running from a proximal end to a distal end of the boom, a winch that winds up and releases the wire rope; and a hook that is lifted and lowered by winding up and releasing the wire rope in a state where the hook is hung by the wire rope.

There is a crane that includes a hook to be stored below a boom when a wire rope is further wound in a state where the hook is in contact with the boom (see PTL 2). Such a crane prevents the hook from swinging during traveling, which in turn prevents the hook from colliding with the boom and the like. However, in case an operator falsely recognizes that the hook has already been stored and finishes the operation even though winding up of the wire rope is insufficient, the hook sags again owing to vibrations during traveling, causing a possibility that the hook collides with the ground or the like. Accordingly, a crane has been required that prevents the operator from falsely recognizing that the hook has already been stored in case winding up of the wire rope is insufficient owing to any cause.

CITATION LIST

Patent Literature

PTL 1
Japanese Patent Application Laid-Open No. 2015-9939
PTL 2
Japanese Patent Application Laid-Open No. 2011-98824

SUMMARY OF INVENTION

Technical Problem

A crane is provided that prevents the operator from falsely recognizing that the hook has already been stored in case winding up of the wire rope is insufficient owing to any cause.

Solution to Problem

A first invention is directed to a crane, including:

a boom;

a wire rope running from a proximal end to a distal end of the boom:

a winch winding up and releasing the wire rope; and a hook being lifted and lowered by winding up and releasing the wire rope in a state where the hook is hung by the wire rope, the hook being stored below the boom when the wire rope is further wound up in a state where the hook is in contact with the boom, in which the winch is configured to be moved by a hydraulic motor, the crane further includes:

a pressure sensor capable of detecting a pressure of hydraulic fluid to be delivered to the hydraulic motor; and a controller capable of recognizing change in pressure of the hydraulic fluid, based on a signal from the pressure sensor, and the crane further includes an abnormality notification section capable of issuing a notification of abnormality at least pertaining to storing of the hook, and the controller actuates the abnormality notification section in a case where it is determined that the pressure of the hydraulic fluid falls below a lower limit value when the hook is stored.

A second invention is directed to the crane according to the first invention, in which the controller actuates the abnormality notification section in a case where it is determined that the pressure of the hydraulic fluid exceeds an upper limit value when the hook is stored.

A third invention is directed to the crane according to the first invention, further including a supply blocking section capable of blocking supply of the hydraulic fluid, in which the controller actuates the supply blocking section in a case where it is determined that the pressure of the hydraulic fluid exceeds an upper limit value when the hook is stored.

A fourth invention is directed to the crane according to the third invention, in which a direction switching valve is configured to switch a flow direction of the hydraulic fluid, the crane includes, as the supply blocking section, an operation signal pressure unload valve capable of releasing a signal pressure of the direction switching valve, and the controller actuates the operation signal pressure unload valve in a case where it is determined that the pressure of the hydraulic fluid exceeds an upper limit value when the hook is stored.

Advantageous Effects of Invention

This crane according to the first invention actuates the abnormality notification section in a case where the pressure of the hydraulic fluid falls below the lower limit value when the hook is stored. Such a crane actuates the abnormality notification section in case winding up of the wire rope is insufficient owing to any cause. This actuation can prevent an operator from falsely recognizing that storing of the hook has been completed.

The crane according to the second invention actuates the abnormality notification section in a case where the pressure of the hydraulic fluid exceeds the upper limit value when the hook is stored. Such a crane actuates the abnormality notification section in case the load applied to the hydraulic motor exceeds the predetermined value owing to any cause. Accordingly, the operator can recognize occurrence of the abnormality.

The crane according to the third invention actuates the supply blocking section if it is determined that the pressure of the hydraulic fluid exceeds the upper limit value when the hook is stored. Such a crane actuates the supply blocking section in case the load applied to the hydraulic motor exceeds the predetermined value owing to any cause. Accordingly, the operation of storing the hook can be automatically stopped.

The crane according to the fourth invention actuates the operation signal pressure unload valve in a case where it is determined that the pressure of the hydraulic fluid exceeds the upper limit value when the hook is stored. Such a crane actuates the operation signal pressure unload valve in case the load applied to the hydraulic motor exceeds the predetermined value owing to any cause. Accordingly, the operation of storing the hook can be automatically and securely stopped.

DESCRIPTION OF EMBODIMENTS

The technical thought of the present invention is applicable not only to crane 1 described below but also to other cranes.

First, crane 1 is briefly described.

Figure 1:
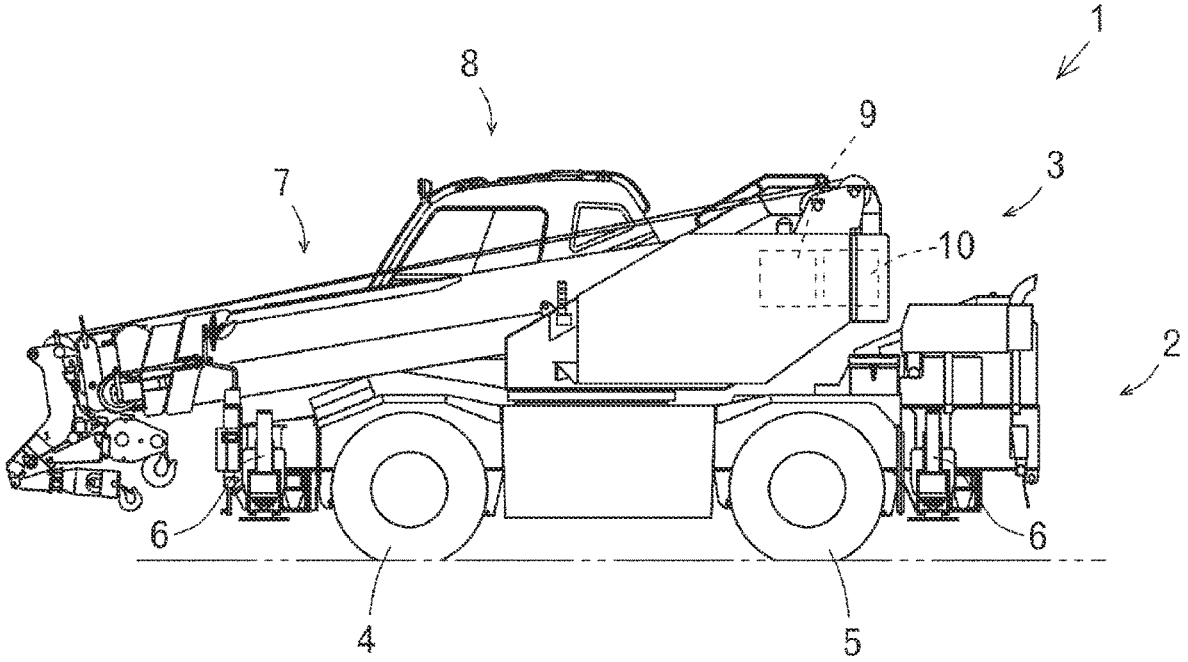
FIG. 1 illustrates a crane during traveling.
Figure 2:
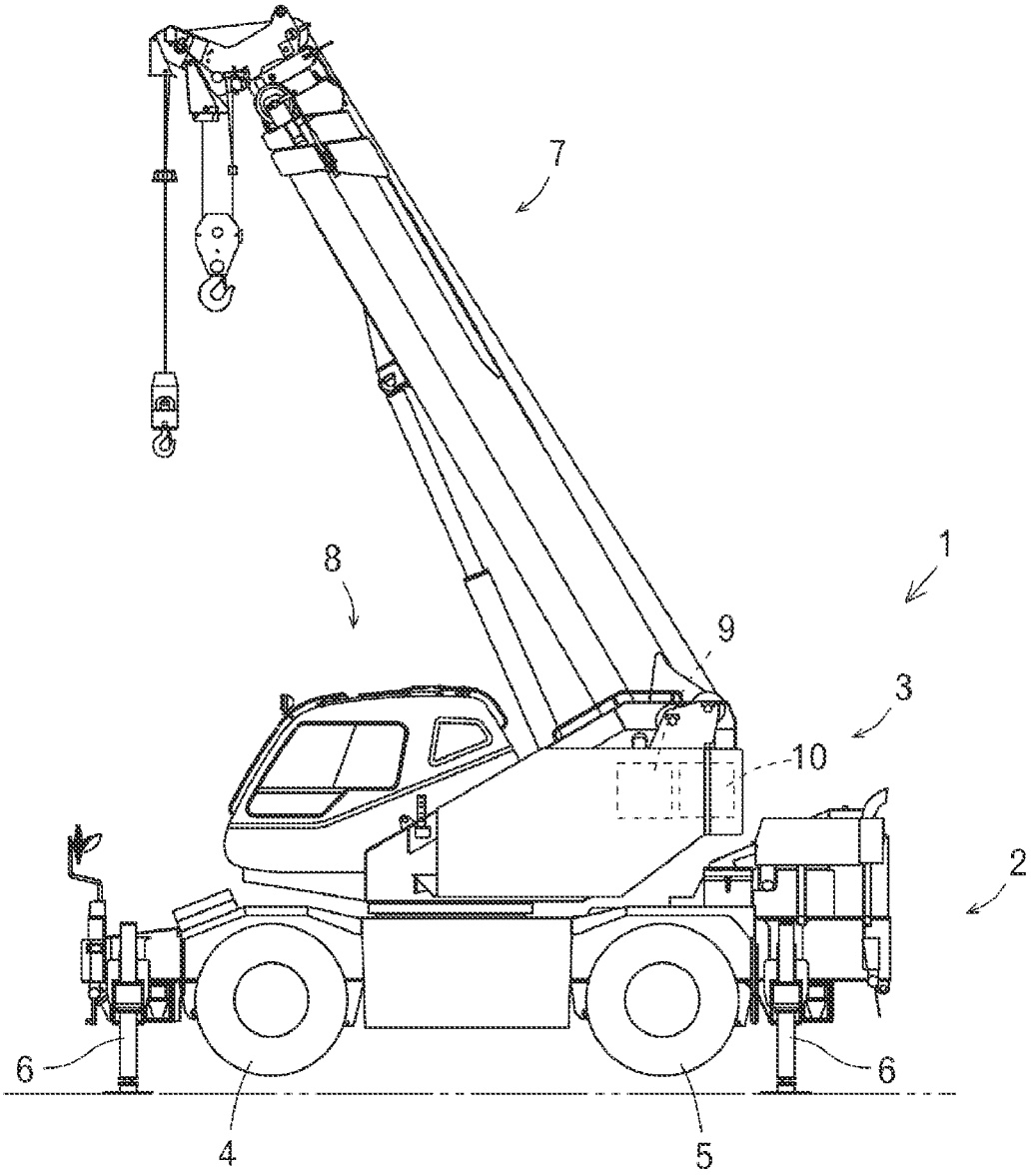
FIG. 2 illustrates the crane during a hoisting operation.
Figure 3:
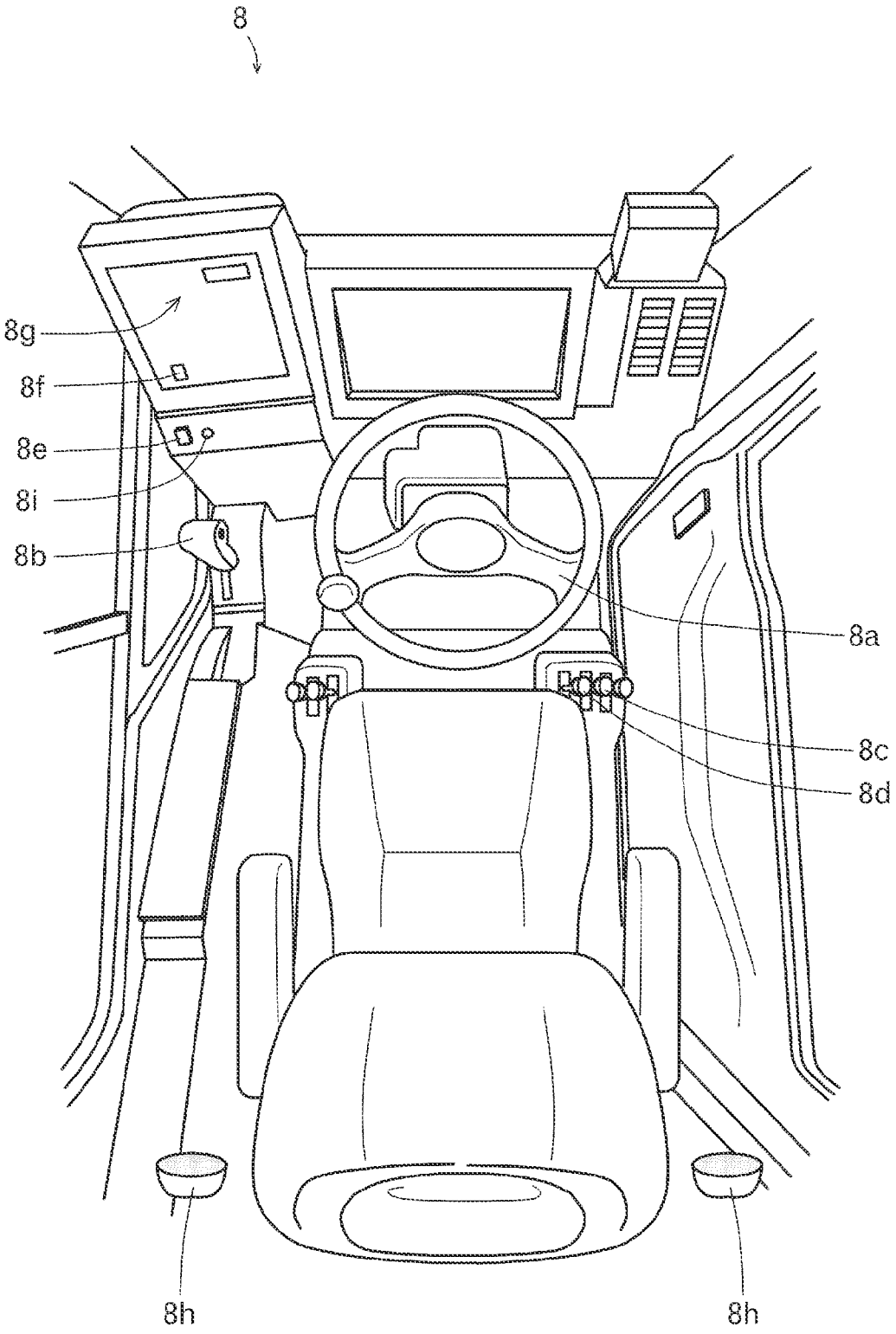
FIG. 3 illustrates the inside of a cabin.

FIG. 1 illustrates crane 1 during traveling. FIG. 2 illustrates crane 1 during a hoisting operation. FIG. 3 illustrates the inside of cabin 8.

Crane 1 mainly includes traveling body 2, and swivel body 3.

Traveling body 2 includes a lateral pair of front tires 4, and a lateral pair of rear tires 5. Furthermore, traveling body 2 includes outriggers 6 that are brought in contact with the ground and facilitates stabilization during the hoisting operation. Moreover, traveling body 2 includes not only a hydraulic actuator for driving these elements but also an engine and a transmission.

Swivel body 3 includes boom 7 so as to protrude forward from the rear. Boom 7 can be freely derricked by the hydraulic actuator, and can freely expand and contract in a multistage manner. Swivel body 3 includes cabin 8 disposed to the right of boom 7. In cabin 8, not only steering wheel 8*a* and shift lever 8*b* that are required for a traveling operation, but also lifting and lowering levers 8*c* and 8*d* that are required for an operation of the hoisting operation are disposed. Swivel body 3 further includes main winch 9, and sub-winch 10.

Next, the structure of boom 7, and the storing operations of main hook 24 and sub-hook 27 are described.

Figure 4:
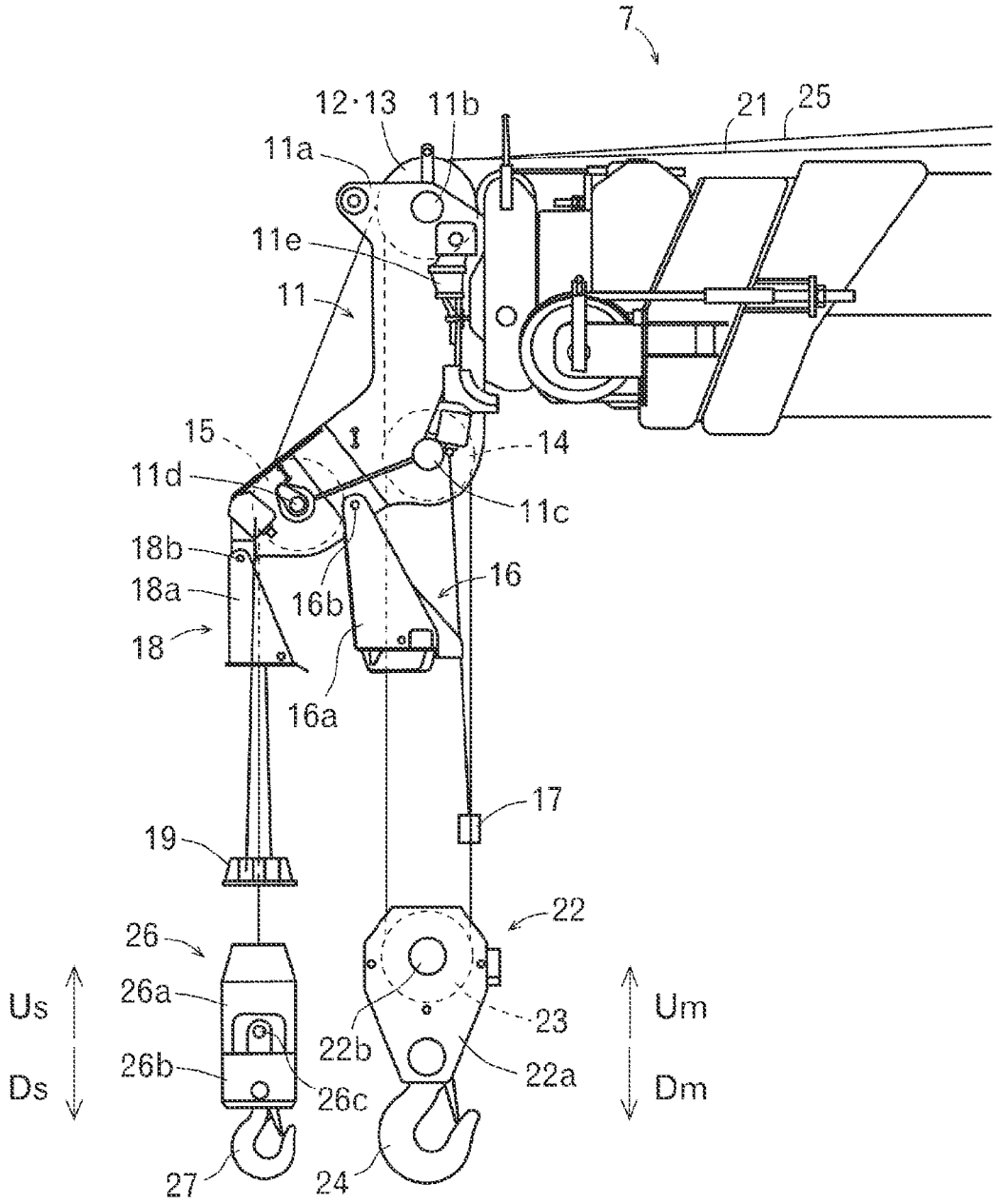
FIG. 4 illustrates a distal end of a boom.
Figure 5:
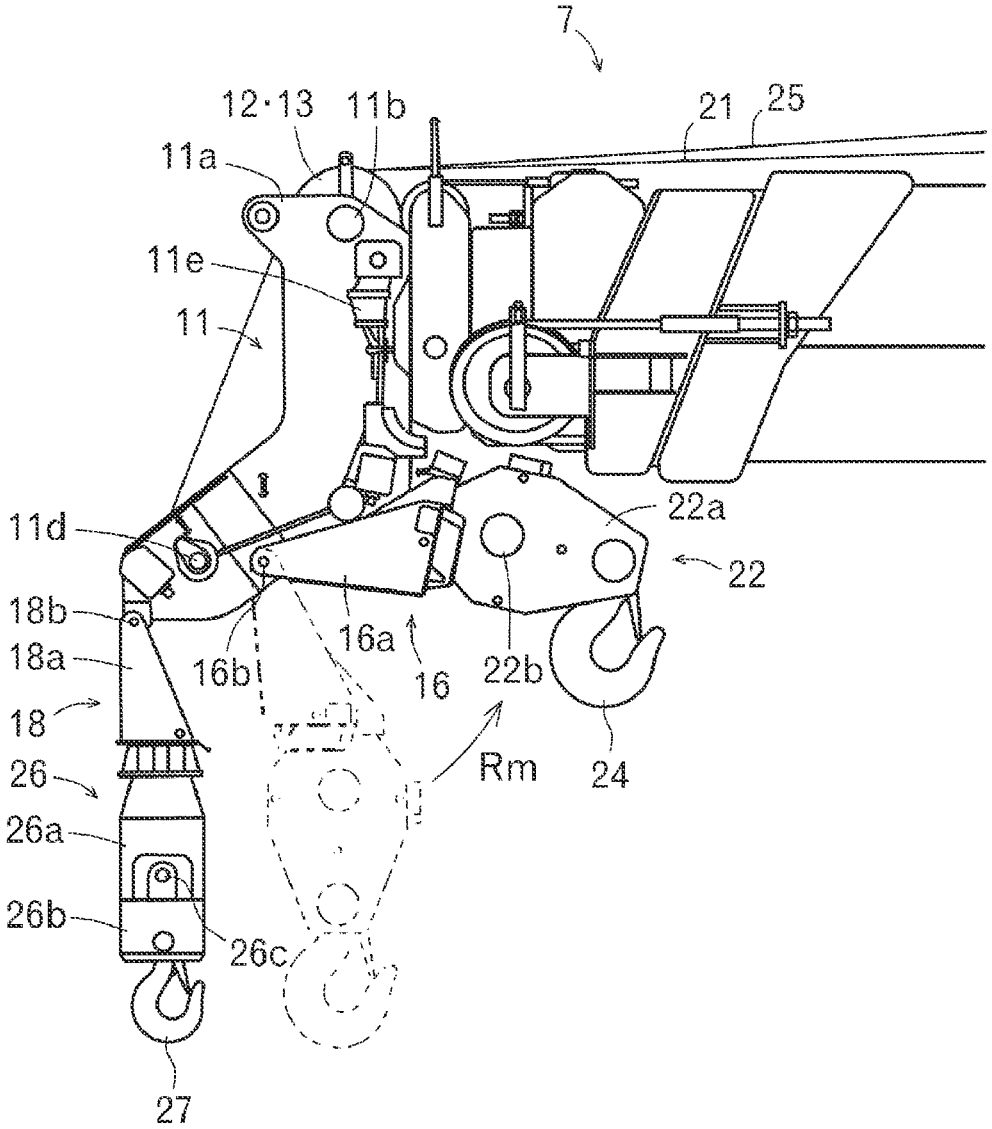
FIG. 5 illustrates a main hook storing operation.
Figure 6:
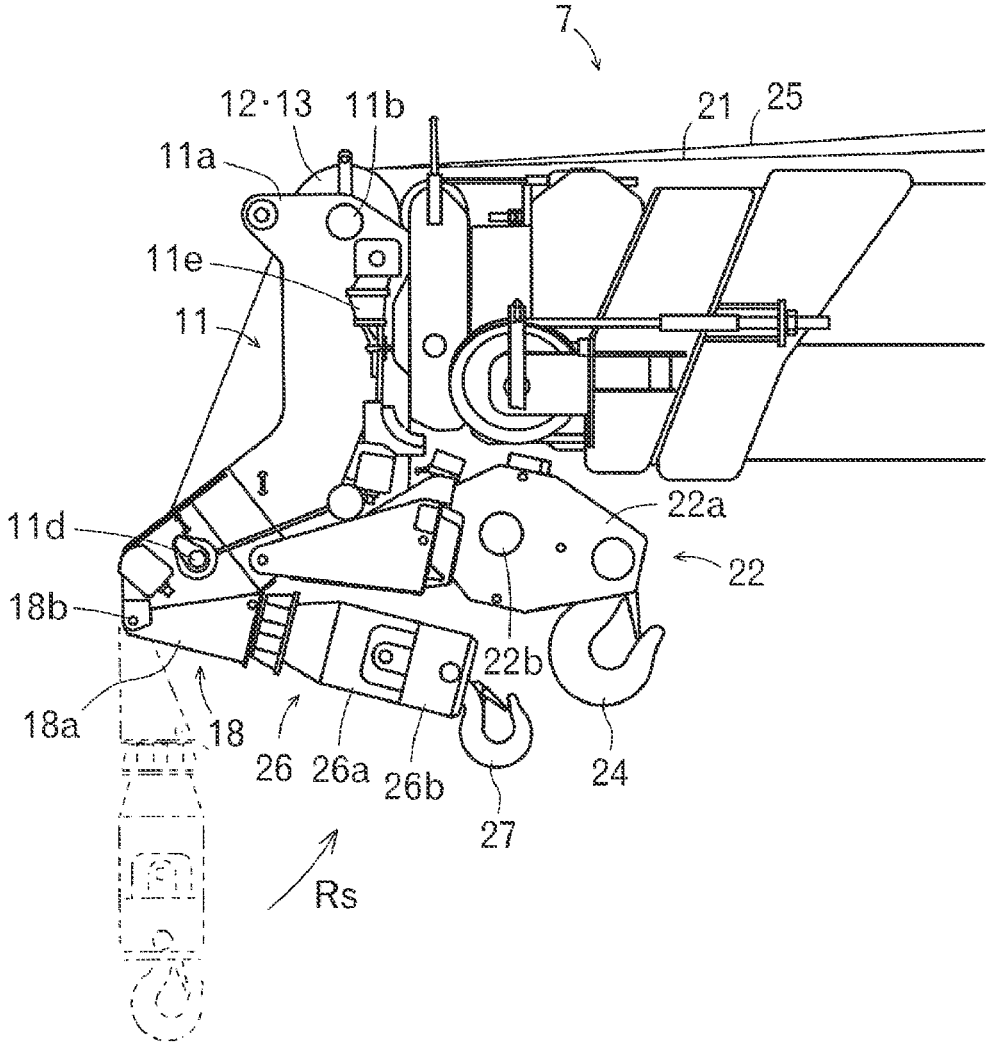
FIG. 6 illustrates a sub-hook storing operation.

FIG. 4 illustrates a distal end of boom 7. FIG. 5 illustrates the storing operation of main hook 24. FIG. 6 illustrates the storing operation of sub-hook 27.

The distal end of boom 7 mainly includes boom head 11, and multiple sheaves 12, 13, 14 and 15.

Boom head 11 has a structure that includes a lateral pair of head plates 11*a* disposed to face each other. One head plate 11*a* is welded to other head plate 11*a* in a state of being arranged in parallel, and their rear ends are attached to boom 7. Boom head 11 includes guide sheave shaft 11*b*, main sheave shaft 11*c*, and sub-sheave shaft 11*d*. These shafts 11*b*, 11*c* and 11*d* are configured in a state where their opposite ends are supported by the lateral pair of head plates 11*a*.

Guide sheave 12 is rotatably supported in a state where guide sheave shaft 11*b* is inserted in the center thereof. Guide sheave 12 is a substantially disk-shaped revolution body, and has a groove for guiding a wire rope (main wire 21) on its outer peripheral surface. A part of guide sheave 12 protrudes upward from an upper surface plate of boom 7. Main wire 21, which runs from the proximal end to the distal end of boom 7, runs around this sheave. Thus, main wire 21, which runs over boom 7, is guided downward around guide sheave 12.

Guide sheave 13 is rotatably supported in a state where guide sheave shaft 11*b* is inserted in the center thereof. Guide sheave 13 is a substantially disk-shaped revolution body, and has a groove for guiding a wire rope (sub-wire 25) on its outer peripheral surface. A part of guide sheave 13 protrudes upward from an upper surface plate of boom 7. Sub-wire 25, which runs from the proximal end to the distal end of boom 7, runs around this sheave. Thus, sub-wire 25, which runs over boom 7, is guided around guide sheave 13 and then forward and downward.

Main sheave 14 is rotatably supported in a state where main sheave shaft 11*c* is inserted in the center thereof. Main sheave 14 is a substantially disk-shaped revolution body, and has a groove for guiding main wire 21 on its outer peripheral surface. Main sheave 14 is disposed below the lower surface plate of boom 7. Main wire 21 runs around this sheave and hook sheave 23, which is described later. Thus, main wire 21 running around guide sheave 12 and then downward, runs around hook sheave 23 and upward, and then is guided around main sheave 14 and downward. Main wire 21 then runs around hook sheave 23 and main sheave 14, and is fixed to wire link 11*e* of boom head 11. The number of windings (the number of runnings) of main wire 21 may be selected from among two (four) and three (six).

Sub-sheave 15 is rotatably supported in a state where sub-sheave shaft 11*d* is inserted in the center thereof. Sub-sheave 15 is a substantially disk-shaped revolution body, and has a groove for guiding sub-wire 25 on its outer peripheral surface. Sub-sheave 15 is disposed below the lower surface plate of boom 7. Sub-wire 25 runs around this sheave. Thus, sub-wire 25, which runs around guide sheave 13 and forward and downward, is guided around sub-sheave 15 and downward. Sub-wire 25 is then fixed to wire link 26*c* of sub-hook block 26, which is described later. The number of windings (the number of runnings) of sub-wire 25 cannot be selected, and is defined as one (one).

Additionally, main bracket 16 is attached to the lower end of boom head 11.

Main bracket 16 has a structure that includes a lateral pair of bracket plates 16*a* disposed to face each other. One bracket plate 16*a* is welded to other bracket plate 16*a* in a state of being arranged in parallel, and their distal ends are attached to boom head 11 via pin 16*b*. Specifically, each bracket plate 16*a* has a substantially trapezoidal shape. A distal end of a side inclined obliquely downward from the upper base to the lower base is attached to boom head 11 via pin 16*b*. Accordingly, main bracket 16 is freely rotatable centered at pin 16*b* until the inclined side of bracket plate 16*a* comes into contact with boom head 11. Main wire 21 runs between the lateral pair of bracket plates 16*a* and then around hook sheave 23 of main hook block 22. Over-winding prevention switch 17 hangs below main bracket 16. Over-winding prevention switch 17 is turned "on" when coming into contact with main hook block 22, and transmits a signal to stop main winch 9. Main hook block 22 is thus prevented from colliding with main bracket 16 and boom 7.

Main hook block 22 has a structure that includes a lateral pair of block plates 22*a* disposed to face each other. One block plate 22*a* is coupled to other block plate 22*a* via multiple rods in a state of being arranged in parallel, and clamps main hook 24 at their lower ends. Main hook block 22 includes hook sheave shaft 22*b*. Hook sheave shaft 22*b* is configured in a state where its opposite ends are supported by the lateral pair of block plates 22*a*.

Hook sheave 23 is rotatably supported in a state where hook sheave shaft 22*b* is inserted in the center thereof. Hook sheave 23 is a substantially disk-shaped revolution body, and has a groove for guiding main wire 21 on its outer peripheral surface. Hook sheave 23 is disposed in main hook block 22. Main wire 21 runs around this sheave and main sheave 14 described above.

As described above, main wire 21 is guided by guide sheave 12, main sheave 14 and hook sheave 23, and is held so as to run along a predetermined route. According to crane 1, when main winch 9 winds up main wire 21, main hook block 22 hung by main wire 21 can be lifted. That is, main hook 24 can be lifted (see arrow Um in FIG. 4). On the contrary, according to crane 1, when main winch 9 releases main wire 21, main hook block 22 hung by main wire 21 can be lowered. That is, main hook 24 can be lowered (see arrow Dm in FIG. 4).

Furthermore, when crane 1 winds up main wire 21 in a state where the function of over-winding prevention switch 17 is invalidated, main hook block 22 can be brought into contact with main bracket 16. When main wire 21 is further wound up, main bracket 16 and main hook block 22 are allowed to turn in a direction approaching boom 7. Thus, crane 1 can store main hook 24 below boom 7 (see arrow Rm in FIG. 5).

Furthermore, sub-bracket 18 is attached to the front end of boom head 11.

Sub-bracket 18 has a structure that includes a lateral pair of bracket plates 18*a* disposed to face each other. One bracket plate 18*a* is welded to other bracket plate 18*a* in a state of being arranged in parallel, and their distal ends are attached to boom head 11 via pin 18*b*. Specifically, each bracket plate 18*a* has a substantially trapezoidal shape. A distal end of a side inclined obliquely downward from the upper base to the lower base is attached to boom head 11 via pin 18*b*. Accordingly, sub-bracket 18 is freely rotatable centered at pin 18*b* until the inclined side of bracket plate 18*a* comes into contact with boom head 11. Sub-wire 25 runs between the lateral pair of bracket plates 18*a* and is fixed to sub-hook block 26. Over-winding prevention switch 19 hangs below sub-bracket 18. Over-winding prevention switch 19 is turned "on" when coming into contact with sub-hook block 26, and transmits a signal to stop sub-winch 10. Sub-hook block 26 is thus prevented from colliding with sub-bracket 18.

Sub-hook block 26 has a structure where block cylinder 26*b* is welded to single block case 26*a*. The inside of block case 26*a* is hollow. A hole through which sub-wire 25 is to be pulled in is formed on an upper end of this case. Block cylinder 26*b* supports sub-hook 27 at the lower end of this cylinder. Sub-hook block 26 further includes wire link 26*c*. Wire link 26*c* is stored in block case 26*a*, and fixes sub-wire 25 drawn therein.

As described above, sub-wire 25 is guided by guide sheave 13 and sub-sheave 15, and is held so as to run along a predetermined route. According to crane 1, when sub-winch 10 winds up sub-wire 25, sub-hook block 26 hung by sub-wire 25 can be lifted. That is, sub-hook 27 can be lifted (see arrow Us in FIG. 4). On the contrary, according to crane 1, when sub-winch 10 releases sub-wire 25, sub-hook block 26 hung by sub-wire 25 can be lowered. That is, sub-hook 27 can be lowered (see arrow Ds in FIG. 4).

Furthermore, when crane 1 winds up sub-wire 25 in a state where the function of over-winding prevention switch 19 is invalidated, sub-hook block 26 can be brought into contact with sub-bracket 18. When sub-wire 25 is further wound up, sub-bracket 18 and sub-hook block 26 are allowed to turn in a direction approaching boom 7. Thus, crane 1 can store sub-hook 27 below boom 7 (see arrow Rs in FIG. 6).

Next, hydraulic circuits that allow the wire ropes to be wound up and released (main wire 21 and sub-wire 25) are described.

A hydraulic circuit that drives main winch 9 and a hydraulic circuit that drives sub-winch 10 have configurations substantially identical to each other. Accordingly, in the present application, the hydraulic circuit that drives main winch 9 is focused and described.

Figure 7:
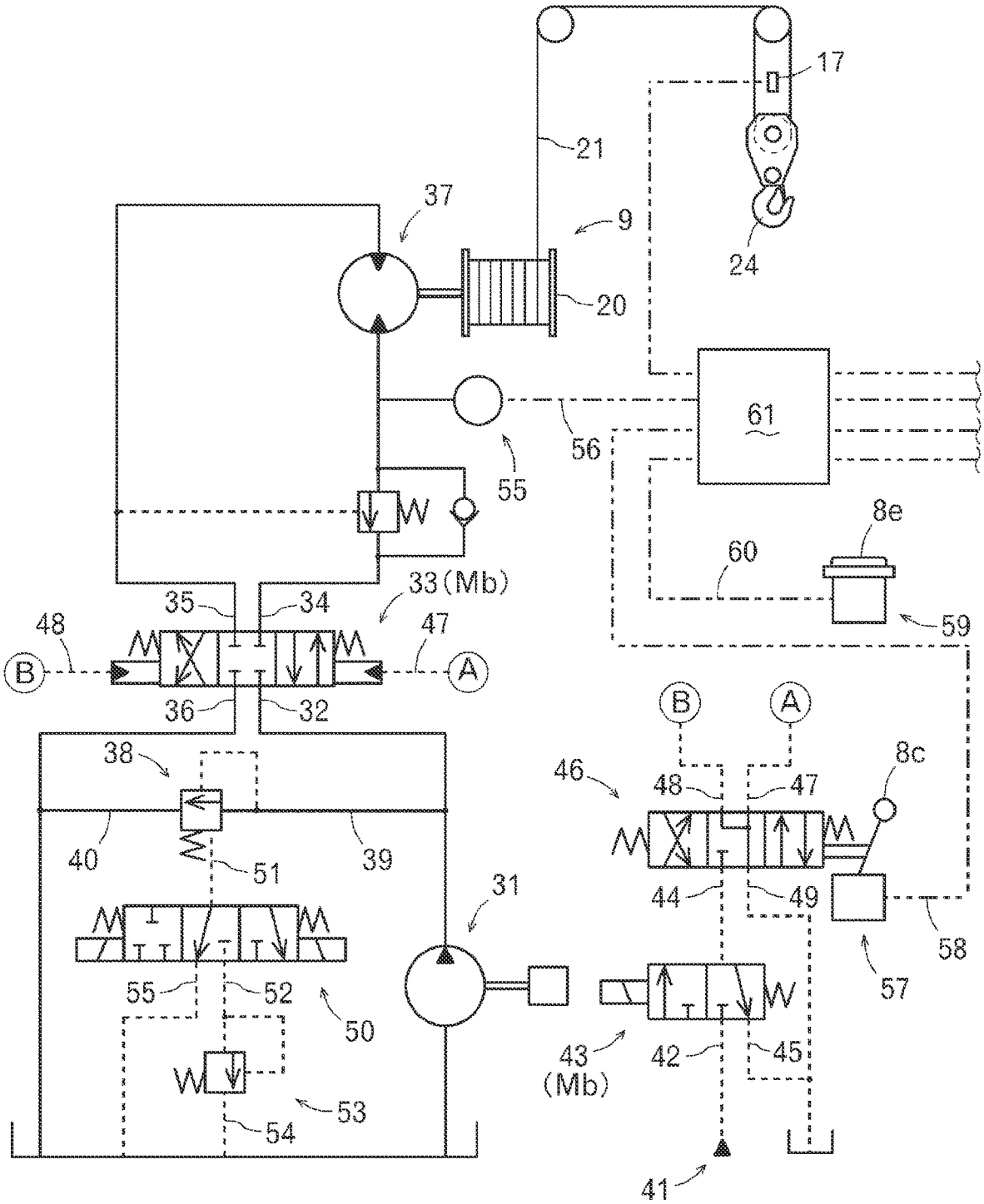
FIG. 7 illustrates a hydraulic circuit of the crane according to Embodiment 1.

FIG. 7 illustrates the hydraulic circuit of crane 1 according to Embodiment 1. Solid lines in the diagram represent hydraulic circuits pertaining to driving of hydraulic motor 37. Broken lines in the diagram represent hydraulic circuits that transmit the pressure of hydraulic fluid as a signal. Chain double-dashed lines in the diagram represent electric circuits.

First, the hydraulic circuit pertaining to driving of hydraulic motor 37 is described. Hereinafter, such a hydraulic circuit is described as "drive circuit".

Hydraulic pump 31 is disposed in the drive circuit. Hydraulic fluid pipe 32 communicates with hydraulic pump 31.

Furthermore, direction switching valve 33 is disposed in the drive circuit. Hydraulic fluid pipe 32 communicates with direction switching valve 33. Accordingly, the hydraulic fluid pumped out from hydraulic pump 31 is supplied to direction switching valve 33 through hydraulic fluid pipe 32. Hydraulic pipes 34, 35 and 36 communicate with direction switching valve 33. Accordingly, actuation in one direction allows the hydraulic fluid to flow into hydraulic fluid pipe 34, while actuation in the other direction allows the hydraulic fluid to flow into hydraulic fluid pipe 35. In all the cases, the hydraulic fluid is discharged through hydraulic fluid pipe 36. Direction switching valve 33 constitutes supply blocking section Mb, described later.

Furthermore, hydraulic motor 37 is disposed in the drive circuit. Hydraulic fluid pipes 34 and 35 communicate with hydraulic motor 37. Accordingly, the hydraulic fluid pumped out from hydraulic pump 31 is supplied to hydraulic motor 37 through hydraulic fluid pipes 32 and 34 or hydraulic fluid pipes 32 and 35. When the hydraulic fluid is supplied through hydraulic fluid pipes 32 and 34, hydraulic motor 37 normally rotates. When the hydraulic fluid is supplied through hydraulic fluid pipes 32 and 35, this motor reversely rotates. Hydraulic motor 37 is coupled to wire drum 20. Accordingly, when hydraulic motor 37 normally rotates, wire drum 20 also normally rotates and winds up main wire 21. On the contrary, when hydraulic motor 37 reversely rotates, wire drum 20 also reversely rotates and releases main wire 21.

Furthermore, pilot-actuated relief valve 38 is disposed in the drive circuit. Hydraulic fluid pipe 39 communicates with pilot-actuated relief valve 38. Hydraulic fluid pipe 39 communicates with hydraulic fluid pipe 32. Accordingly, the hydraulic fluid pumped out from hydraulic pump 31 is supplied to pilot-actuated relief valve 38 through hydraulic fluid pipes 32 and 39. Hydraulic fluid pipe 40 communicates with pilot-actuated relief valve 38. Accordingly, when the pressures in hydraulic fluid pipes 32 and 39 are higher than a predetermined value, the hydraulic fluid is discharged through hydraulic fluid pipe 40. Specifically, this hydraulic circuit can achieve "high-pressure relief mode", "low-pressure relief mode", and "unload state" depending on the actuation state of relief pressure switching valve 50, described later. In "high-pressure relief mode", when the pressures of hydraulic fluid pipes 32 and 39 reach a set value (high-pressure value), pilot-actuated relief valve 38 is opened, and the hydraulic fluid is discharged through hydraulic fluid pipe 40. In "low-pressure relief mode", when the pressures of hydraulic fluid pipes 32 and 39 reach a set value (low-pressure value), pilot-actuated relief valve 38 is opened, and the hydraulic fluid is discharged through hydraulic fluid pipe 40. In "unload state", pilot-actuated relief valve 38 is kept open. Accordingly, the entire hydraulic fluid pumped out from hydraulic pump 31 is discharged through hydraulic fluid pipe 40.

Next, the hydraulic circuit that transmits the pressure of the hydraulic fluid as a signal is described. Hereinafter, such a hydraulic circuit is described as "signal circuit".

Hydraulic pressure source 41 resides in the signal circuit. Hydraulic fluid pipe 42 communicates with hydraulic pressure source 41.

Furthermore, operation signal pressure unload valve 43 is disposed in the signal circuit. Hydraulic fluid pipe 42 communicates with operation signal pressure unload valve 43. A signal pressure is applied to operation signal pressure unload valve 43 via hydraulic fluid pipe 42. Hydraulic fluid pipes 44 and 45 communicate with operation signal pressure unload valve 43. Accordingly, in a case of actuation in one direction, the signal pressure is transmitted to hydraulic fluid pipe 44. In a neutral state, the hydraulic fluid is discharged through hydraulic fluid pipe 45. Operation signal pressure unload valve 43 constitutes supply blocking section Mb, described later.

Furthermore, remote control valve 46 is disposed in the signal circuit. Hydraulic fluid pipe 44 communicates with remote control valve 46. The signal pressure is applied to remote control valve 46 via hydraulic fluid pipe 44. Hydraulic fluid pipes 47 and 48 communicate with remote control valve 46. Accordingly, actuation in one direction allows the signal pressure to be transmitted to hydraulic fluid pipe 47, while actuation in the other direction allows the signal pressure to be transmitted to hydraulic fluid pipe 48. In all the cases, the hydraulic fluid is discharged through hydraulic fluid pipe 49. When the signal pressure is transmitted to hydraulic fluid pipe 47, direction switching valve 33 is actuated in one direction. When the signal pressure is transmitted to hydraulic fluid pipe 48, direction switching valve 33 is actuated in the other direction.

Furthermore, relief pressure switching valve 50 is disposed in the signal circuit. As described above, relief pressure switching valve 50 allows switching among "high-pressure relief mode", "low-pressure relief mode" and "unload state". Specifically, in a case of actuation of relief pressure switching valve 50 in one direction, hydraulic fluid pipe 51 is blocked. Accordingly, when the pressures of hydraulic fluid pipes 32 and 39 become a set value (high-pressure value) or higher, pilot-actuated relief valve 38 is opened, and "high-pressure relief mode" that exerts a function serving as a safety valve is achieved. In a case of actuation of relief pressure switching valve 50 in the other direction, hydraulic fluid pipe 51 communicates with a hydraulic tank via hydraulic fluid pipe 52, low-pressure relief valve 53 and hydraulic fluid pipe 54. Accordingly, when the pressures of hydraulic fluid pipes 32 and 39 become a set value (low-pressure value) or higher, pilot-actuated relief valve 38 is opened, and "low-pressure relief mode" that exerts the function serving as the safety valve is achieved. That is, the actuation pressure of pilot-actuated relief valve 38 is regulated to a pressure set by low-pressure relief valve 53, thereby achieving "low-pressure relief mode" allowing opening at a value lower than the value in "high-pressure relief mode". In a case where relief pressure switching valve 50 is in the neutral state, hydraulic fluid pipe 51 communicates with the hydraulic tank via hydraulic fluid pipe 55, and pilot-actuated relief valve 38 is opened. Accordingly, "unload state" where the entire hydraulic fluid pumped out from hydraulic pump 31 is discharged is achieved.

When crane 1 performs the hoisting operation, crane 1 is in "high-pressure relief mode" so as to exert the hoisting capability. When the stability limit or strength limit of crane 1 is likely to be exceeded, the state is brought into "unload state", thereby stopping the hoisting operation (the actuation of main winch 9 is stopped). In a case where the mode is left in "high-pressure relief mode" when main hook 24 is stored below boom 7, the force of winding up main wire 21 is too strong. Accordingly, there is a possibility that a large load is applied to main bracket 16, boom 7 and the like, which are then damaged. To address this, the mode is brought into "low-pressure relief mode", which prevents main bracket 16, boom 7 and the like from being subjected to a large load.

Next, an electric circuit is described.

Pressure sensor 55 is disposed in the electric circuit. Electric wire 56 is connected to pressure sensor 55. Pressure sensor 55 is attached to hydraulic fluid pipe 34. Accordingly, pressure sensor 55 can detect the pressure in hydraulic fluid pipe 34.

Furthermore, position sensor 57 is disposed in the electric circuit. Electric wire 58 is connected to position sensor 57. Position sensor 57 is attached to operation lever 8*c* that actuates remote control valve 46. Accordingly, position sensor 57 can detect the inclined direction of operation lever 8*c*.

Furthermore, cancel switch 59 is disposed in the electric circuit. Electric wire 60 is connected to cancel switch 59. Cancel switch 59 is attached to cancel button (also called "over-winding button") 8*e* that invalidates the function of over-winding prevention switch 17. Accordingly, cancel switch 59 can issue an instruction of invalidating the function of over-winding prevention switch 17.

Furthermore, controller 61 is disposed in the electric circuit. Electric wires 56, 58 and 60 are connected to controller 61. Accordingly, controller 61 can recognize the pressure of hydraulic fluid to be delivered to hydraulic motor 37 and change in the pressure, the inclined direction of operation lever 8*c*, and the instruction for invalidating the function of over-winding prevention switch 17. Multiple electric wires are connected to controller 61. These electric wires are connected to operation signal pressure unload valve 43 and relief pressure switching valve 50. Accordingly, controller 61 can appropriately control these valves 43 and 50.

Hereinafter, a control mode pertaining to storing of main hook 24 is described.

Figure 8:
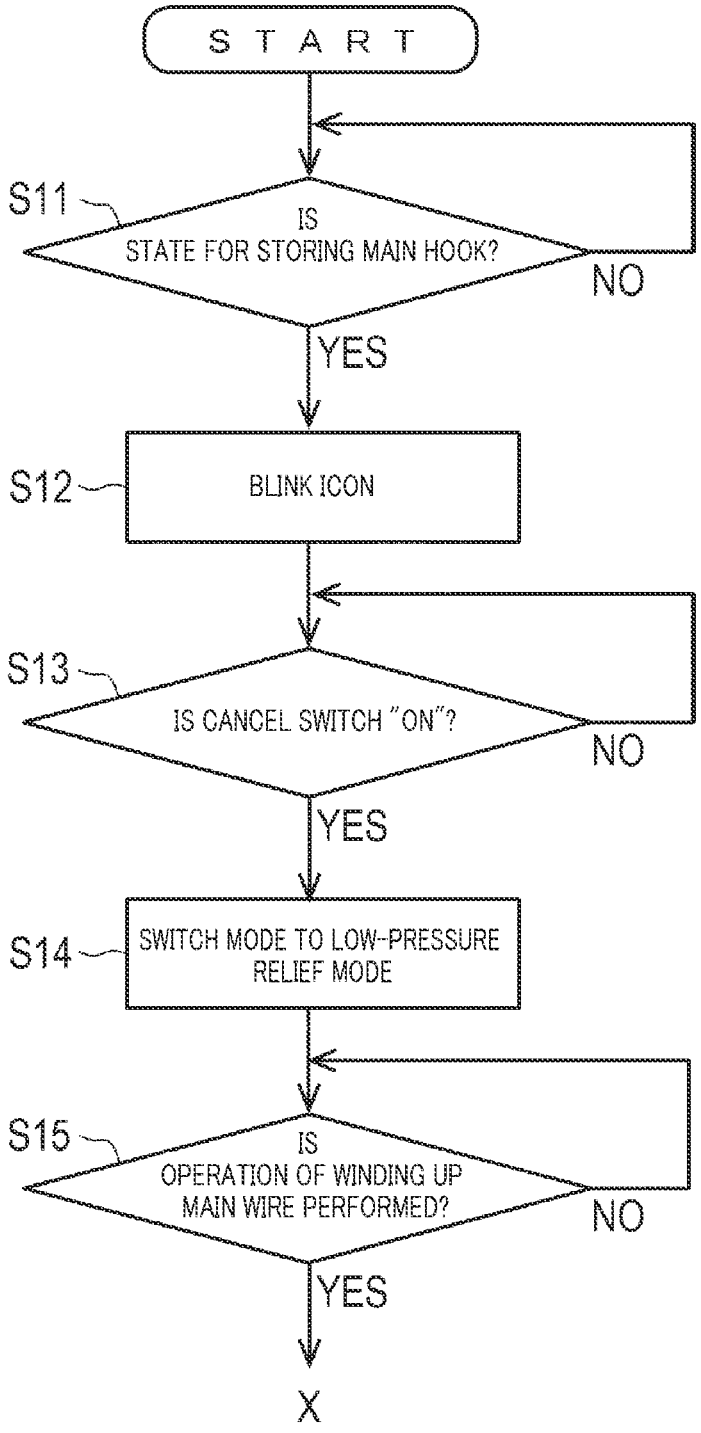
FIG. 8 illustrates a process of a controller when the main hook is stored.
Figure 9:
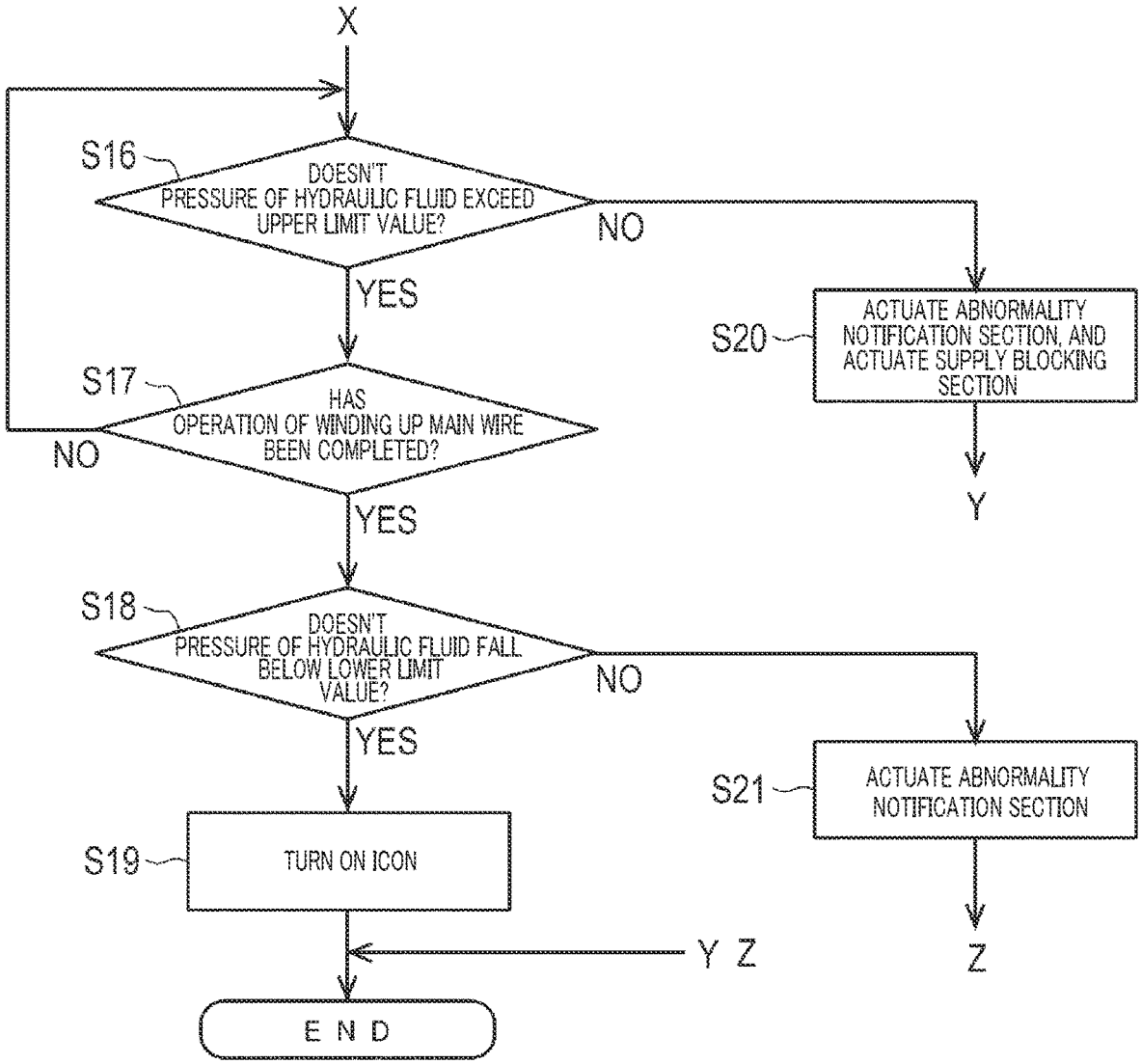
FIG. 9 illustrates the process of the controller when the main hook is stored.

FIGS. 8 and 9 illustrate the process of controller 61 when main hook 24 is stored.

In step S11, controller 61 determines whether or not the state is for storing main hook 24. Specifically, it is determined whether the state is for storing main hook 24 or not on the basis of the state of the engine, the attitude of boom 7 and the like. In a case where the state is for storing main hook 24, the processing transitions to step S12.

In step S12, controller 61 blinks icon 8*f* (see FIG. 3). Specifically, icon 8*f* representing that the state for storing main hook 24 is achieved is blinked.

In step S13, controller 61 determines whether cancel switch 59 is "on" or not. In a case where cancel switch 59 is "on", the processing transitions to step S14.

In step S14, controller 61 switches the mode to "low-pressure relief mode". Specifically, relief pressure switching valve 50 is actuated to the other direction to switch the mode to "low-pressure relief mode". Accordingly, the pressure of hydraulic fluid to be delivered to hydraulic motor 37 decreases. As described above, "high-pressure relief mode" is switched to "low-pressure relief mode" during storing of main hook 24 in order to prevent main bracket 16, boom 7 and the like from being subjected to a large load and from being damaged.

In step S15, controller 61 determines whether the operation of winding up main wire 21 is performed or not. Specifically, it is determined whether the operation of winding up main wire 21 is performed or not on the basis of the signal from position sensor 57. In a case where the operation of winding up main wire 21 is performed, the processing transitions to step S16. In a case where the operation of winding up main wire 21 is performed, main winch 9 is operated.

In step S16, controller 61 determines whether the pressure of hydraulic fluid does not exceed (falls below) the upper limit value or not. Specifically, it is determined whether the pressure of hydraulic fluid does not exceed (falls below) the setting value on the upper limit side in "low-pressure relief mode" (the value may be a value having a predetermined allowance from the setting value) or not on the basis of the signal from pressure sensor 55. In a case where the pressure of hydraulic fluid does not exceed the upper limit value, the processing transitions to step S17.

In step S17, controller 61 determines whether the operation of winding up main wire 21 has been completed or not. Specifically, it is determined whether the operation of winding up main wire 21 has been completed or not on the basis of the signal from position sensor 57. In a case where the operation of winding up main wire 21 has been completed, the processing transitions to step S18. In a case where the operation of winding up main wire 21 has been completed, main winch 9 is stopped. Completion of the operation of winding up main wire 21 means that an operator determines that storing of main hook 24 has been completed.

In step S18, controller 61 determines whether the pressure of hydraulic fluid does not fall below (exceeds) the lower limit value or not. Specifically, it is determined whether the pressure of hydraulic fluid does not fall below (exceeds) the setting value on the lower limit side in "low-pressure relief mode" (the value may be a value having a predetermined allowance from the setting value) or not on the basis of the signal from pressure sensor 55. In a case where the pressure of hydraulic fluid does not fall below the lower limit value, the processing transitions to step S19.

In step S19, controller 61 turns on icon 8*f*. Specifically, icon 8*f* blinking to represent that main hook 24 is stored is turned on.

As described above, controller 61 performs processes on the basis of signals from pressure sensor 55, position sensor 57 and the like. Appropriate instructions are issued to operation signal pressure unload valve 43, relief pressure switching valve 50 and the like, thereby allowing main hook 24 to be stored.

Note that, in step S16, controller 61 causes the processing to transition to step S20 in a case where the pressure of the hydraulic fluid exceeds the upper limit value. Various causes can be considered for the fact that the pressure of the hydraulic fluid exceeds the upper limit value. For example, the causes include a case where relief pressure switching valve 50 malfunctions and the mode is not switched to "low-pressure relief mode".

In step S20, controller 61 actuates abnormality notification section Mi. Specifically, a warning image is displayed on monitor 8*g* that constitutes abnormality notification section Mi (see FIG. 3). Alternatively, speaker 8*h* that constitutes abnormality notification section Mi may issue a warning sound. Further alternatively, lamp 8*i* that constitutes abnormality notification section Mi may be turned on. At the same time, controller 61 actuates supply blocking section Mb. Specifically, operation signal pressure unload valve 43 constituting supply blocking section Mb is actuated to the other direction to release the signal pressure applied to direction switching valve 33, thereby bringing direction switching valve 33 into the neutral state. Accordingly, winding up of main wire 21 is stopped. This, in turn, stops lifting of main hook 24. A method of stopping winding up main wire 21 may be a method of bringing relief pressure switching valve 50 into the neutral state and bringing hydraulic fluid pipes 32 and 39 into "unload state". However, a possible case where relief pressure switching valve 50 malfunctions and is not switched to "low-pressure relief mode" is assumed. Accordingly, a mode of bringing operation signal pressure unload valve 43 into the neutral state and bringing hydraulic fluid pipes 44, 47 and 48 into "unload state" is regarded to have higher reliability.

Additionally, in step S18, controller 61 causes the processing to transition to step S21 in a case where the pressure of the hydraulic fluid falls below the lower limit value. Various causes can be considered for the fact that the pressure of the hydraulic fluid falls below the lower limit value. The causes include, for example, a case of insufficient winding up of main wire 21 as a result of the operator's falsely recognizing that storing of main hook 24 has been completed and then finishing the operation.

In step S21, controller 61 actuates abnormality notification section Mi. Specifically, a warning image is displayed on monitor 8*g* that constitutes abnormality notification section Mi (see FIG. 3). Alternatively, speaker 8*h* that constitutes abnormality notification section Mi may issue a warning sound. Further alternatively, lamp 8*i* that constitutes abnormality notification section Mi may be turned on.

According to the above description, the characteristics and advantageous effects of this crane 1 are summarized as follows.

<Characteristic 1>

This crane 1 actuates abnormality notification section Mi in a case where it is determined that the pressure of the hydraulic fluid falls below the lower limit value when the hook (main hook 24) is stored. Such crane 1 actuates abnormality notification section Mi in case winding up of the wire rope (main wire 21) is insufficient owing to any cause. This actuation can prevent the operator from falsely recognizing that storing of hook (24) has been completed.

<Characteristic 2>

This crane 1 actuates abnormality notification section Mi in a case where it is determined that the pressure of the hydraulic fluid exceeds the upper limit value when the hook (main hook 24) is stored. Such crane 1 actuates abnormality notification section Mi in case the load applied to hydraulic motor 37 exceeds the predetermined value owing to any cause. Accordingly, the operator can recognize occurrence of the abnormality.

<Characteristic 3>

This crane 1 actuates supply blocking section Mb in a case where it is determined that the pressure of the hydraulic fluid exceeds the upper limit value when the hook (main hook 24) is stored. Such crane 1 actuates supply blocking section Mb in case the load applied to hydraulic motor 37 exceeds the predetermined value owing to any cause. Accordingly, the operation of storing hook (24) can be automatically stopped.

<Characteristic 4>

This crane 1 actuates operation signal pressure unload valve 43 in a case where it is determined that the pressure of the hydraulic fluid exceeds the upper limit value when the hook (main hook 24) is stored. Such crane 1 actuates operation signal pressure unload valve 43 in case the load applied to hydraulic motor 37 exceeds the predetermined value owing to any cause. Accordingly, the operation of storing hook (24) can be automatically and securely stopped.

These characteristics and their advantageous effects are also applicable to storing of sub-hook 27.

Next, hydraulic circuits of cranes 1 according to other embodiments are described.

Figure 10:
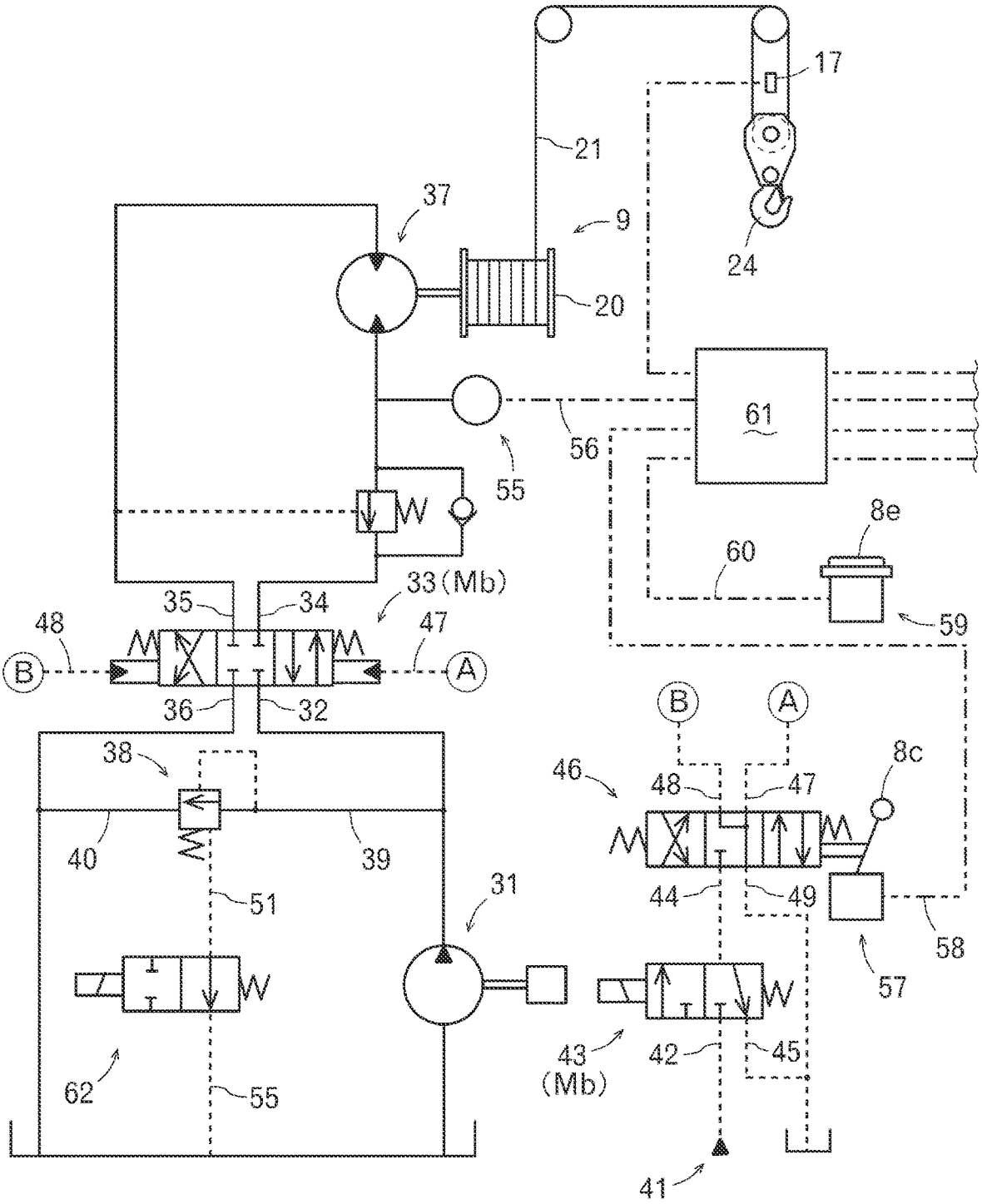
FIG. 10 illustrates a hydraulic circuit of a crane according to Embodiment 2.
Figure 11:
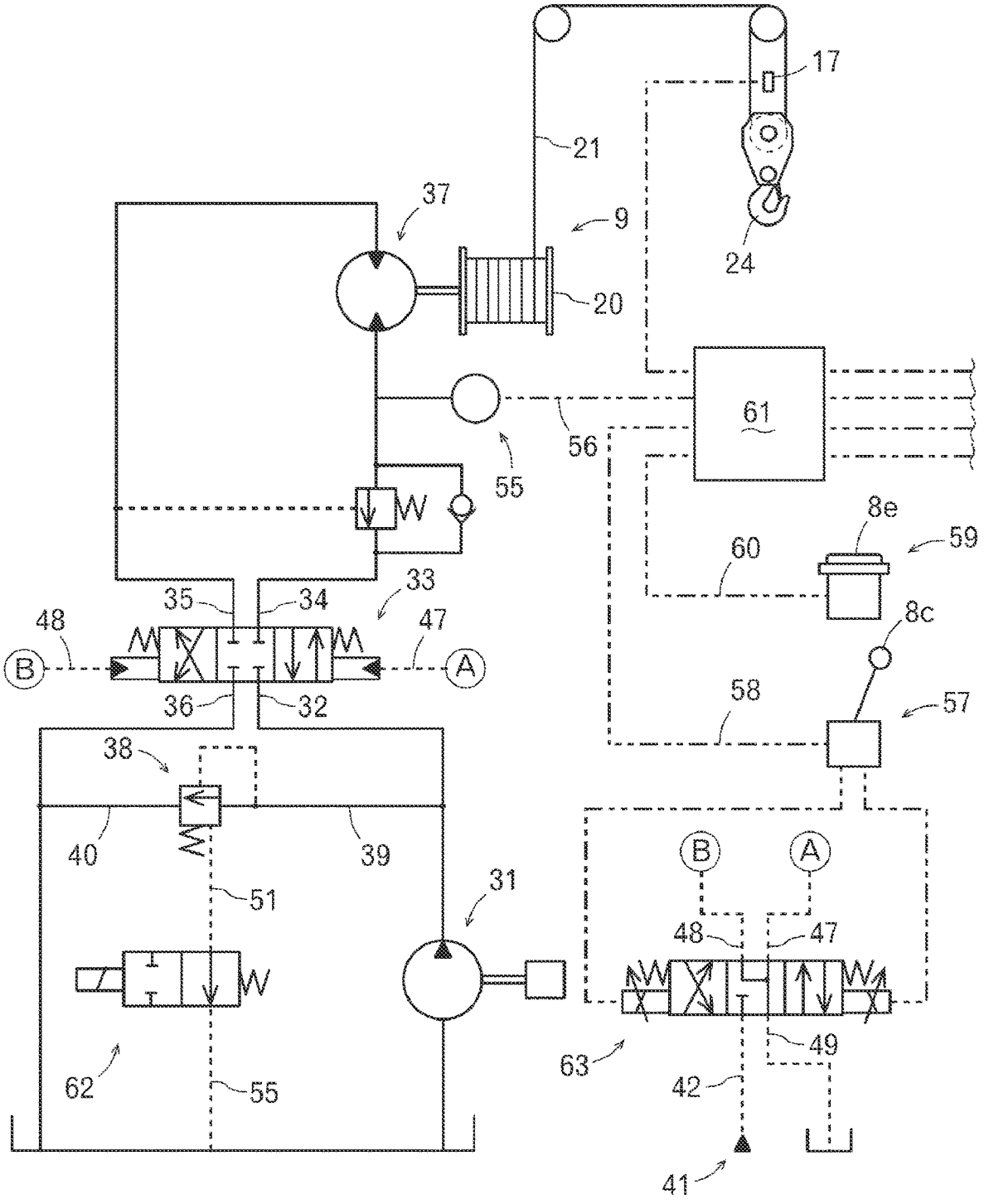
FIG. 11 illustrates a hydraulic circuit of a crane according to Embodiment 3.

FIG. 10 illustrates the hydraulic circuit of crane 1 according to embodiment 2. FIG. 11 illustrates the hydraulic circuit of crane 1 according to embodiment 3.

The hydraulic circuit of crane 1 according to Embodiment 2 has a configuration where relief pressure switching valve 50 is replaced with electromagnetic valve 62 that can switch between two alternatives, or opening and closing, and low-pressure relief valve 53 is removed.

Unlike crane 1 according to Embodiment 1, such a configuration cannot bring the mode to "low-pressure relief mode" when main hook 24 is stored. However, in a case where controller 61 appropriately actuates supply blocking section Mb, no problem occurs. That is, only in a case where operation signal pressure unload valve 43 can be brought into the neutral state to stop wiring up of main wire 21 when the pressure detected by pressure sensor 55 exceeds the setting value in "low-pressure relief mode", the hydraulic circuit of achieving "low-pressure relief mode" is not required to be configured from the beginning. Such a hydraulic circuit can reduce the cost.

The hydraulic circuit of crane 1 according to Embodiment 3 has a configuration where remote control valve 46 is replaced with electromagnetic proportional remote control valve 63 capable of flow rate control, and operation signal pressure unload valve 43, relief pressure switching valve 50 and low-pressure relief valve 53 are removed.

Unlike crane 1 according to Embodiment 1, such a configuration cannot bring the mode to "low-pressure relief mode" when main hook 24 is stored. Furthermore, operation signal pressure unload valve 43 cannot be brought into the neutral state to stop winding up of main wire 21. However, in a case where controller 61 controls electromagnetic proportional remote control valve 63 to adjust the signal pressure and controls the flow rate of the hydraulic fluid to be delivered to hydraulic motor 37, no problem occurs. That is, only in a case where, when the pressure detected by pressure sensor 55 exceeds the setting value in "low-pressure relief mode", electromagnetic proportional remote control valve 63 can be controlled to adjust the signal pressure, and the flow rate of the hydraulic fluid to be delivered to hydraulic motor 37 can be controlled to stop winding up of main wire 21 appropriately, the hydraulic circuit that achieves "low-pressure relief mode" and the hydraulic circuit that achieves blocking of the hydraulic fluid to be delivered to hydraulic motor 37 are not required to be configured. Such a hydraulic circuit can further reduce the cost.

The present invention can be used for a crane.

REFERENCE SIGNS LIST

1 Crane
7 Boom
9 Main winch (winch)
16 Main bracket
17 Over-winding prevention switch
21 Main wire (wire rope)
24 Main hook (hook)
31 Hydraulic pump
33 Direction switching valve
37 Hydraulic motor
38 Pilot-actuated relief valve
41 Hydraulic pressure source
43 Operation signal pressure unload valve
46 Remote control valve
50 Relief pressure switching valve
53 Low-pressure relief valve
55 Pressure sensor
57 Position sensor
59 Cancel switch
61 Controller
62 Electromagnetic valve
63 Electromagnetic proportional remote control valve
Mb Supply blocking section
Mi Abnormality notification section

The invention claimed is:

1. A crane, comprising:

a boom;

a wire rope that runs from a proximal end to a distal end of the boom;

a winch that is driven by a hydraulic motor, and that winds up the wire rope and releases the wire rope;

a hook that is lifted and lowered by winding up and releasing the wire rope in a state where the hook is hung by the wire rope, the hook being stored below the boom by further winding up the wire rope from a state where the hook is in contact with the boom;

a pressure sensor that detects a pressure of hydraulic fluid to be delivered to the hydraulic motor;

an abnormality notification section that issues a notification of abnormality at least pertaining to storing of the hook; and a controller that recognizes a change in pressure of the hydraulic fluid, based on a signal from the pressure sensor, the controller actuating the abnormality notification section in a case where it is determined that the pressure of the hydraulic fluid falls below a lower limit value when the hook is stored.

2. The crane according to claim 1, wherein the controller actuates the abnormality notification section in a case where it is determined that the pressure of the hydraulic fluid exceeds an upper limit value when the hook is stored.

3. The crane according to claim 1, further comprising a supply blocking section capable of blocking supply of the hydraulic fluid, wherein the controller actuates the supply blocking section in a case where it is determined that the pressure of the hydraulic fluid exceeds an upper limit value when the hook is stored.

4. The crane according to claim 3, wherein a direction switching valve is configured to switch a flow direction of the hydraulic fluid, the crane comprises, as the supply blocking section, an operation signal pressure unload valve capable of releasing a signal pressure of the direction switching valve, and the controller actuates the operation signal pressure unload valve in a case where it is determined that the pressure of the hydraulic fluid exceeds an upper limit value when the hook is stored.

* * * * *